US009057992B2

(12) United States Patent
Ishii et al.

(10) Patent No.: US 9,057,992 B2
(45) Date of Patent: Jun. 16, 2015

(54) FIXING DEVICE INCLUDING FIXING BELT WITH HOLES

(71) Applicant: KYOCERA Document Solutions Inc., Osaka (JP)

(72) Inventors: Satoshi Ishii, Osaka (JP); Keiichi Tanida, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/176,042

(22) Filed: Feb. 7, 2014

(65) Prior Publication Data

US 2014/0219695 A1 Aug. 7, 2014

(30) Foreign Application Priority Data

Feb. 7, 2013 (JP) ..... 2013-021926

(51) Int. Cl.
*G03G 15/20* (2006.01)

(52) U.S. Cl.
CPC ..... *G03G 15/2053* (2013.01); *G03G 15/2028* (2013.01); *G03G 2215/2035* (2013.01)

(58) Field of Classification Search
CPC ..... G03G 15/2085; G03G 15/2057; G03G 15/2053
USPC ..... 399/329, 333
See application file for complete search history.

(56) References Cited

U.S. PATENT DOCUMENTS

2013/0034374 A1* 2/2013 Ohtsu et al. ..... 399/329

FOREIGN PATENT DOCUMENTS

JP 2004-029394 A 1/2004
JP 2004-286840 A 10/2004
JP 2007171694 A * 7/2007

OTHER PUBLICATIONS

Komuro (JP 2007-171694 A), Feb. 2013, JPO Computer Translation.*

* cited by examiner

*Primary Examiner* — David Gray
*Assistant Examiner* — Erika J Villaluna
(74) *Attorney, Agent, or Firm* — James W. Judge

(57) ABSTRACT

A fixing device includes an endless fixing belt, a heating unit, a supporting member, and a pressure roller. The pressure roller sandwiches the fixing belt to form a fixing nip portion between the pressure roller and the fixing belt. The fixing device is configured to insert a recording medium into the fixing nip portion to fix an unfixed toner image carried on the recording medium. The fixing belt includes a heating layer and a sliding layer. The heating layer is configured to generate heat using the heating unit. The sliding layer is laminated onto an inner circumferential surface of the fixing belt and sliding on the supporting member. The plurality of holes are formed in the sliding layer such that the sliding layer has a mesh pattern in plan view.

13 Claims, 7 Drawing Sheets

FIXING DEVICE INCLUDING FIXING BELT WITH HOLES

CROSS-REFERENCE TO RELATED APPLICATION

This application is based upon, and claims the benefit of priority from, corresponding Japanese Patent Application No. 2013-021926 filed in the Japan Patent Office on Feb. 7, 2013, the entire contents of which are incorporated herein by reference.

BACKGROUND

Unless otherwise indicated herein, the description in this section is not prior art to the claims in this application and is not admitted to be prior art by inclusion in this section.

The disclosure relates to a fixing device that employs a belt fixing method where a paper sheet carrying an unfixed toner image is inserted into a fixing nip portion, which is formed by a heated fixing belt and a pressure member, and the unfixed toner is heated and melted for fixation on the paper sheet. The disclosure also relates to an image forming apparatus including the fixing device employing an electrophotographic method.

In the conventional image forming apparatus that employs the electrophotographic method, the following belt fixing method has been developed. Instead of a heating roller, an endless fixing belt that absorbs radiant heat from a heat source and generates heat is employed as a heating member for heating the paper sheet. The paper sheet carrying an unfixed toner image is inserted into a fixing nip portion formed by the heated fixing belt and a pressure member, which is brought into pressure contact with the fixing belt, thus a toner is fixed on the paper sheet.

In this belt fixing method, at least one of a fixing roller pair forming the fixing nip portion is used as a heating roller. Inserting the paper sheet carrying the unfixed toner image into the fixing nip portion can decrease thermal capacity and shorten a warm-up period, thus reducing power consumption, compared with a heat roller fixing method fixing a toner on a paper sheet.

The following methods for driving the fixing belt are known, for example. Flange-shaped end cap members are secured on both ends of the endless fixing belt in a rotation shaft direction. The fixing belt is driven via a gear formed at the end cap members. Alternatively, the fixing belt is driven with a suspension roller disposed downstream of a nip portion inside of the endless fixing belt.

However, with the above-described method of directly driving the fixing belt, pressing members, such as the end cap member and the suspension roller disposed inside of the fixing belt, may need to be rotated. Accordingly, it was difficult to freely configure a shape and a width of the nip portion.

As a method for expanding a nip width, for example, a method of using a pressure roller with large diameter, a method of increasing rubber thickness or reducing rubber hardness at a surface of the pressure roller, or a method of enhancing pressing force by the pressure roller are generally known. However, the pressure roller with large diameter may result in large-size fixing device and a cost increase, whereas an increase in rubber thickness may result in extension of the warm-up period. Reduction in rubber hardness increases a change in outer diameter due to temperature, causing reduction in conveyability, also degrading durability. Further, elevation in the pressing force by the pressure roller leads to reduction in conveyability due to excessive amount of deflection of the roller surface and a cost increase due to reinforcement of a fixing frame.

Therefore, the following sliding-belt fixing method has been devised. A supporting member is disposed inside of the fixing belt. A pressure roller is brought into pressure contact with the supporting member from outside of the fixing belt. At the same time, a friction force between the pressure roller and the outer surface of the fixing belt slides the supporting member and the inner surface of the fixing belt, thus rotating the fixing belt.

The following fixing device has been disclosed, for example. The fixing device includes a fixing belt, a radiant heat source (halogen heater) inside of the belt, a supporting member with a sliding surface, and a pressure roller. Rotatably driving the pressure roller to slide a fixing belt and the supporting member at a nip portion formed by the fixing belt and the pressure roller, thus rotating the fixing belt.

With the above-described sliding-belt fixing method, to rotate the fixing belt smoothly, slidability between the fixing belt and the supporting member may need to be ensured. Accordingly, another fixing belt has been disclosed. A sliding layer, which forms a sliding surface on a side sliding along the supporting member of the fixing belt (inner circumferential surface), is disposed. This ensures the improved wear resistance and slidability of the belt inner circumferential surface.

SUMMARY

A fixing device includes an endless fixing belt, a heating unit, a supporting member, and a pressure roller. The endless fixing belt is configured to move at a peripheral speed approximately a same as a recording medium's conveyance speed. The heating unit is disposed at an inner side of the fixing belt. The heating unit is configured to heat the fixing belt by radiant heat. The supporting member is disposed at the inner side of the fixing belt. The supporting member is configured to slide along an inner circumferential surface of the fixing belt. The pressure roller sandwiches the fixing belt to form a fixing nip portion between the pressure roller and the fixing belt. The pressure roller is brought into pressure contact with the supporting member at a predetermined pressure so as to impart rotary driving force to the fixing belt. The fixing device is configured to insert a recording medium into the fixing nip portion to fix an unfixed toner image carried on the recording medium. The fixing belt includes a heating layer and a sliding layer. The heating layer is configured to generate heat using the heating unit. The sliding layer is laminated onto an inner circumferential surface of the fixing belt and sliding on the supporting member. The plurality of holes are formed in the sliding layer such that the sliding layer has a mesh pattern in plan view.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

FIG. 5 illustrates a staggered pattern in which rows of the holes 47*a* neighboring in a circumferential direction of the fixing belt 21 (vertical direction in FIG. 5) are shifted widthwise (lateral direction in FIG. 5) by a half pitch in every one row.

DETAILED DESCRIPTION

Figure 1:
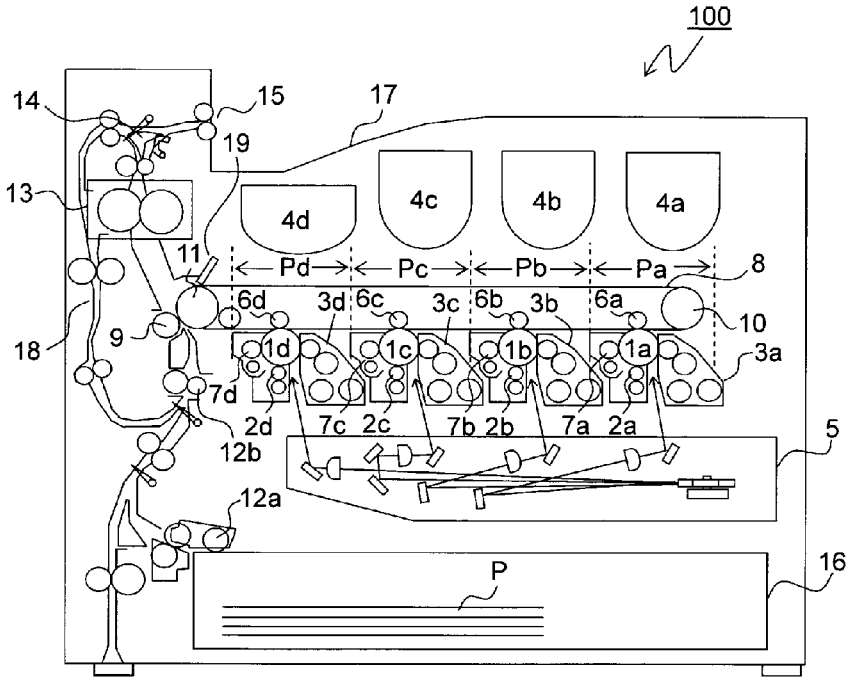
FIG. 1 is a schematic cross-sectional view of a color printer 100 with a fixing device 13 according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the disclosure, as generally described herein, and illustrated in the drawings, can be arranged, substituted, combined, separated, and designed in a wide variety of different configurations, all of which are explicitly contemplated herein.

The following describes an embodiment of the disclosure with reference to the drawings. FIG. 1 is a schematic cross-sectional view illustrating a configuration of an image forming apparatus including a fixing device 13 of the disclosure. Here, as an example of the image forming apparatus, a tandem electrophotographic color printer is illustrated. A color printer 100 includes four image forming units Pa, Pb, Pc, and Pd in this order from upstream in the conveying direction (right side in FIG. 1) in a main body. These image forming units Pa to Pd are disposed corresponding to images of different four colors (magenta, cyan, yellow, and black). The respective image forming units Pa to Pd sequentially form images of magenta, cyan, yellow, and black through each process of charge, exposure, develop, and transfer.

These image forming units Pa to Pd respectively include photoreceptor drums 1*a*, 1*b*, 1*c*, and 1*d* that carry visible images of each color (toner image). Additionally, an intermediate transfer belt 8 is disposed adjacent to each of the image forming units Pa to Pd. The intermediate transfer belt 8 rotates clockwise in FIG. 1 by a driving unit (not illustrated). Toner images formed on these photoreceptor drums 1*a* to 1*d* are primarily transferred on the intermediate transfer belt 8, which moves while contacting each of the photoreceptor drum 1*a* to 1*d* sequentially and superimposed. Then, by an action of a secondary transfer roller 9, the toner images are secondarily transferred on a paper sheet P as one example of a recording medium. Furthermore, after being fixed on the paper sheet P in the fixing device 13, the paper sheet P is discharged from the main body of the color printer 100. While the photoreceptor drums 1*a* to 1*d* are rotated anticlockwise in FIG. 1, an image forming process is performed on each of the photoreceptor drums 1*a* to 1*d*.

The paper sheet P on which the toner images are transferred is housed in a paper sheet cassette 16 disposed below the main body of the color printer 100. The paper sheet P is conveyed to a nip portion formed by the secondary transfer roller 9 and a drive roller 11, which will be described later, of the intermediate transfer belt 8, via a paper feed roller 12*a* and a registration roller pair 12*b*. A sheet made of dielectric resin is used for the intermediate transfer belt 8 and a jointless (seamless) belt is mainly used. A blade-shaped belt cleaner 19 is disposed downstream of the secondary transfer roller 9. The belt cleaner 19 removes, for example, a toner remained on a surface of the intermediate transfer belt 8.

Next, the image forming units Pa to Pd will be described. Chargers 2*a*, 2*b*, 2*c*, and 2*d*, which charge the respective photoreceptor drums 1*a* to 1*d*, an exposure device 5, which exposes image information on the respective photoreceptor drums 1*a* to 1*d*, developing devices 3*a*, 3*b*, 3*c*, and 3*d*, which form the toner images on the respective photoreceptor drums 1*a* to 1*d*, and cleaning units 7*a*, 7*b*, 7*c*, and 7*d*, which remove, for example, a developer (toner) remained on the respective photoreceptor drums 1*a* to 1*d*, are disposed around and below of the respective photoreceptor drums 1*a* to 1*d*, which are rotatably disposed.

When image data is input from a host apparatus, such as a personal computer, first, the chargers 2*a* to 2*d* evenly charge the surfaces of the photoreceptor drums 1*a* to 1*d*. Then, the exposure device 5 irradiates light according to the image data to form an electrostatic latent image according to the image data on the respective photoreceptor drums 1*a* to 1*d*. A predetermined amount of two-component developer including toners of each color, magenta, cyan, yellow, and black, is filled to the respective developing devices 3*a* to 3*d*. If formation of the toner image, which will be described later, decreases a proportion of toner in the two-component developer filled in the respective developing devices 3*a* to 3*d* to below the specified value, toner containers 4*a* to 4*d* replenish the respective developing devices 3*a* to 3*d* with toners. The developing devices 3*a* to 3*d* supply the toners in the developer on the photoreceptor drums 1*a* to 1*d*. Electrostatic adhesion of the toners forms toner images according to the electrostatic latent images formed by exposure using the exposure device 5.

Then, primary transfer rollers 6*a* to 6*d* produce an electric field at a predetermined transfer voltage between the primary transfer rollers 6*a* to 6*d* and the photoreceptor drums 1*a* to 1*d*. Then, the toner images of magenta, cyan, yellow, and black on the photoreceptor drums 1*a* to 1*d* are primarily transferred on the intermediate transfer belt 8. These four-color images are formed having a predetermined positional relationship predefined for a predetermined full-color image formation. Afterwards, to prepare for formation of new electrostatic latent image to be continuously performed, the cleaning units 7*a* to 7*d* remove toner and similar substances remained on the surfaces of the photoreceptor drums 1*a* to 1*d* after the primary transfer.

The intermediate transfer belt 8 is bridged across a driven roller 10 on the upstream side and the drive roller 11 on the downstream side. When the intermediate transfer belt 8 starts rotation clockwise in accordance with rotation of the drive roller 11 by a driving motor (not illustrated), the paper sheet P is conveyed to a nip portion (secondary transfer nip portion), which is formed by the drive roller 11 and the secondary transfer roller 9 adjacent to the drive roller 11, from the registration roller pair 12*b* at a predetermined time point, and the full color image on the intermediate transfer belt 8 is transferred on the paper sheet P. The paper sheet P on which the toner image is transferred is conveyed to the fixing device 13.

Figure 2:
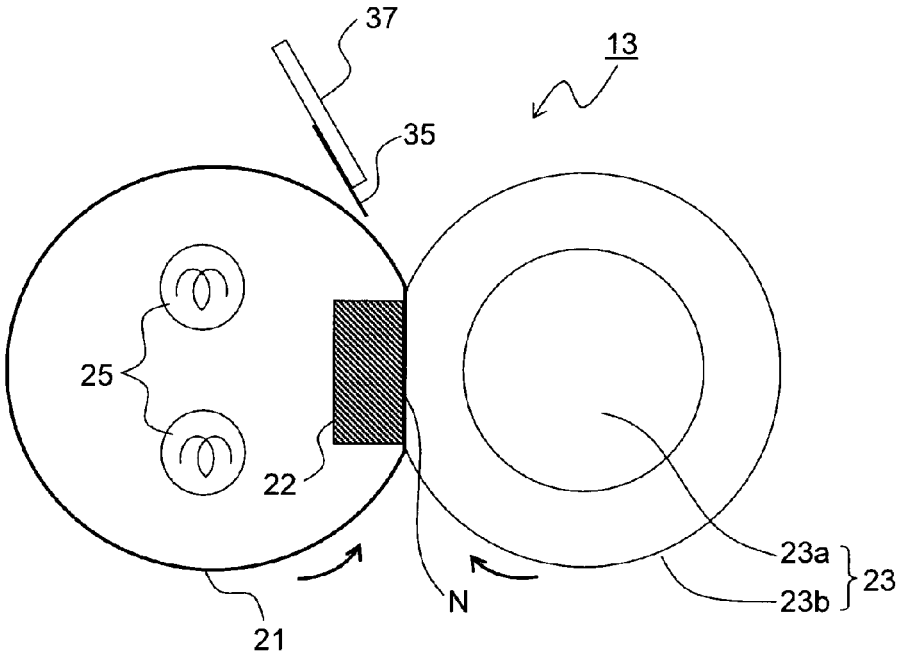
FIG. 2 is a cross-sectional side view of the fixing device 13.

The paper sheet P conveyed to the fixing device 13 is heated and pressurized by the fixing belt 21 and the pressure roller 23 (see FIG. 2). Thus, the toner image is fixed on the surface of the paper sheet P, and the predetermined full color image is formed. The paper sheets P on which the full color images are formed are distributed to different conveyance directions of a branch unit 14 branched to a plurality of directions. In formation of an image only on one surface of the paper sheet P, the paper sheet P is directly discharged to a discharge tray 17 by a discharge roller pair 15.

On the other hand, in formation of images on both surfaces of the paper sheet P, the paper sheet P passing through the fixing device 13 is once conveyed in the discharge roller pair 15 direction. After the rear end of the paper sheet P passes through the branch unit 14, the discharge roller pair 15 is inversely rotated to switch the conveying direction of the branch unit 14. Accordingly, the paper sheet P is distributed to an inverting conveyance passage 18 from the rear end of the paper sheet P, thus the paper sheet P is conveyed to the secondary transfer nip portion again with the image surface inverted. Then, the secondary transfer roller 9 transfers the next image formed on the intermediate transfer belt 8 to the surface of the paper sheet P without image. After the paper sheet P is conveyed to the fixing device 13 and the toner images are fixed, the paper sheet P is discharged to the discharge tray 17.

FIG. 2 is a cross-sectional side view of the fixing device 13 according to one embodiment of the disclosure. As illustrated in FIG. 2, the fixing device 13 includes an endless fixing belt 21, a supporting member 22, a pressure roller 23, and a halogen heater 25. The fixing belt 21 rotates anticlockwise in FIG. 2 so as to move at a peripheral speed approximately the same as a conveyance speed of the paper sheet P. The supporting member 22 contacts the inside of the fixing belt 21. The pressure roller 23 is brought into pressure contact with the supporting member 22 via the fixing belt 21 and rotates clockwise in FIG. 2. The halogen heater 25 is disposed inside of the fixing belt 21.

The fixing belt 21 is wound and hung around a supporting member (not illustrated), which forms an arch shape in cross-sectional view, internally contacting the fixing belt 21 at the supporting member 22 and the opposite side to the supporting member 22. A predetermined tension is provided to the fixing belt 21. Instead of the supporting member, an arc-shaped flange unit may be disposed. The flange unit projects from an inner surface of a fixing housing (not illustrated) and internally contacts both end portions of the fixing belt 21 in the width direction.

A thermistor (not illustrated) is disposed so as to be in contact with the surface of the fixing belt 21. This thermistor detects a temperature of the fixing belt 21. A fixing temperature is controlled by turning ON/OFF the halogen heater 25. Here, the surface temperature of the fixing belt 21 is set to 140° C.

Dimensions of the fixing belt 21 in the width direction (direction perpendicular to the paper of FIG. 2) is set larger than a maximum width of the paper sheet passing through a fixing nip portion N. This allows the fixing belt 21 to cover all surfaces of the paper sheet regardless of the paper sheet size, preventing adhesion of unfixed toners to the supporting member 22 and the pressure roller 23.

By contacting the pressure roller 23 via the fixing belt 21, the supporting member 22 forms the fixing nip portion N into which the paper sheet is inserted. Here, the fixing nip width is set to 12 mm. As a material of the supporting member 22, a heat resistant resin such as liquid crystal polymer or similar material is used. To reduce a sliding load of a contact surface (sliding surface) with the fixing belt 21, a fluorine resin-based coat layer, such as a PTFE sheet, is formed. An elastic layer such as silicone rubber may be disposed inside of the coat layer.

The pressure roller 23 includes an elastic layer 23*b* outside of a cored bar 23*a*, for example. The cored bar 23*a* includes pressure adjustment mechanisms (not illustrated) that adjust pressure from the pressure roller 23 at both end portions. A fixing load of 200 N on one side, total of 400 N, is applied. This embodiment uses the pressure roller 23 with outer diameter of 30 mm with a foamed silicone rubber layer. The foamed silicone rubber layer includes the elastic layer 23*b* outside of the iron cored bar 23*a* with a diameter of 20 mm and has a thickness of 5 mm. The pressure roller 23 is rotated clockwise at a peripheral velocity of 300 mm/sec by the driving motor (not illustrated). To enhance a release property, the surface of the pressure roller 23 is coated with a PFA tube with a thickness of 50 μm.

A separation plate 35 and a separation plate holder 37 are disposed at the downstream side of the fixing nip portion N with respect to the paper sheet conveying direction (from lower to upper direction in FIG. 2). The separation plate 35 separates a paper sheet from the fixing belt 21. The separation plate holder 37 supports the separation plate 35.

Figure 3:
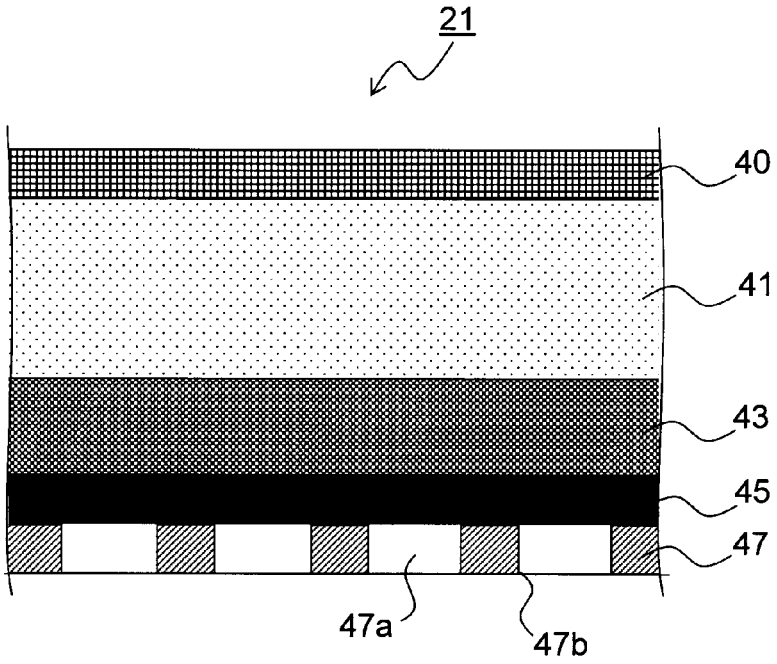
FIG. 3 is a partial cross-sectional view Illustrating a laminated structure of a fixing belt 21 used for the fixing device 13.
Figure 4:
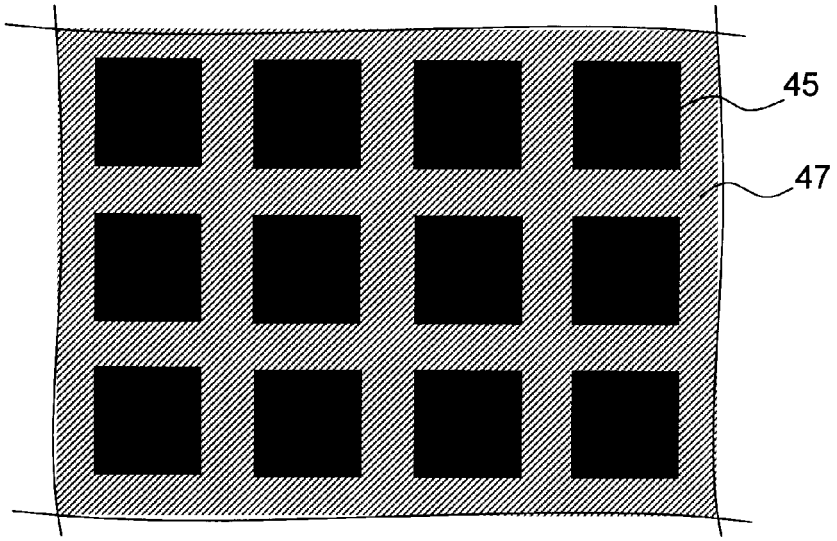
FIG. 4 is a partial plan view of the fixing belt 21 viewed from a sliding layer 47 side.

FIG. 3 is a partial cross-sectional view Illustrating a laminated structure of the fixing belt 21 used for the fixing device 13 of this embodiment. FIG. 4 is a partial plan view of the fixing belt 21 viewed from a sliding layer 47 side. In FIG. 3, the upper side surface is a belt outer surface contacting the pressure roller 23 while the lower side surface is a belt inner surface contacting the supporting member 22. FIG. 4 illustrates a state of the fixing belt 21 viewed from the downward direction in FIG. 3.

The fixing belt 21 laminates five layers: a release layer 40, an elastic layer 41, a heating layer (base material layer) 43, a heat absorption layer 45, and the sliding layer 47 in an order from the outer surface side.

The release layer 40 is a layer to minimize adhesion of melted toner to the fixing belt 21. As the release layer 40, fluorine-based resin such as polytetrafluoroethylene (PTFE) and tetrafluoroethylene-perfluoroalkylvinylether copolymer (PFA). The release layer 40 is formed by applying a coating or covering a tube. A thickness of appropriately 10 μm to 50 μm is approximate for the PFA tube and a thickness of appropriately 10 μm to 30 μm is approximate for the fluorine resin coating. Here, the PFA tube with a thickness of 30 μm is used.

The elastic layer 41 is a layer that ensures high image quality of images by wrapping an unfixed toner image on the paper sheet that passes through the fixing nip portion N and fixes the unfixed toner image softly. As the elastic layer 41, a silicone rubber layer with a thickness of approximately 100 μm to 1000 μm is appropriate. Here, the silicone rubber layer with a thickness of 200 μm is used.

The heating layer 43 functions as a base material of the fixing belt 21 and generates heat using heat from the halogen heater 25. As the heating layer 43, a metal layer with a thickness of 30 μm to 50 μm whose metal, such as nickel or stainless steel, is plated or rolled is used.

The heat absorption layer 45 absorbs radiant heat from the halogen heater 25 and transmits the radiant heat to the heating layer 43. The heat absorption layer 45 also uniformly holds a temperature of the surface of the fixing belt 21 so as not to release heat generated at the heating layer 43. Disposing the heat absorption layer 45 enhances heating efficiency of the heating layer 43, providing effects of shortening the warm-up period and reducing power consumption.

The heat absorption layer 45 is constituted of: silicone rubber whose coefficient of thermal conductivity is enhanced by combining metal oxide powder, such as silica, alumina, and magnesium oxide, as a filler; or a metal with high coefficient of thermal conductivity, such as aluminum, copper, and nickel. The heat absorption layer 45 is formed by molding these materials into a tube shape and coating the molded product, or plating these materials, for example. It is only necessary that the heat absorption layer 45 is an elastic material like silicone rubber. However, if the wall thickness is too thickly formed with a metal, hardness of the belt is increased, failing to obtain an amount of nip required for melting the toner. Accordingly, the thickness of the heat absorption layer 45 is configured to be 5 μm to 500 μm, preferably, 10 μm to 100 μm.

The sliding layer 47 smoothly rotates the fixing belt 21 and reduces abrasion at the inner surface of the fixing belt 21 by enhancing slidability between the inner surface of the fixing belt 21 and the supporting member 22. As the sliding layer 47, for example, polyimide resin, polyamide resin, polyamide-imide resin, and fluorine-based resin, featuring excellent slidability and wear resistance, are used.

As a constitution of the fixing belt 21 used for the fixing device 13 of the embodiment, for example, electroformed nickel with a thickness of 40 μm is formed as the heating layer 43 and a silicone rubber layer with a thickness of 200 μm is laminated on the surface of the heating layer 43 as the elastic layer 41. Meanwhile, as the heat absorption layer 45, heat absorbing coating (manufactured by Okitsumo Incorporated.) with a thickness of 20 μm is applied over the back surface of the heating layer 43. Then, the elastic layer 41 is coated with the release layer 40 made of the PFA tube with a thickness of 30 μm. An endless belt with an inner diameter of 40 mm where the sliding layer 47 made of polyamide-imide with a thickness of 15 μm is formed on the heat absorption layer 45 is used as the fixing belt 21.

As illustrated in FIG. 4, viewed from the inner surface side of the fixing belt 21, the sliding layer 47 has a mesh pattern in plan view where a large number of holes 47*a* reaching the heat absorption layer 45 from the surface are arranged in a matrix in the width direction (lateral direction in FIG. 4) and the circumferential direction (vertical direction in FIG. 4) of the fixing belt 21. The heat absorption layer 45 is exposed through the holes 47*a*. With this configuration, radiant heat from the halogen heater 25 disposed inside of the fixing belt 21 passes through the hole 47*a* of the sliding layer 47 of the fixing belt 21 and is directly absorbed to the heat absorption layer 45. Consequently, the heat absorption layer 45 can efficiently absorb the radiant heat without interrupt by the sliding layer 47 of low coefficient of thermal conductivity and the heating layer is 43 also efficiently heated. Then, heat is spread from the metallic heating layer 43 of high coefficient of thermal conductivity, thus the release layer 40, which forms outer surfaces of the elastic layer 41 and the fixing belt 21, is uniformly heated.

Accordingly, even if the sliding layer 47 is made of polyamide-imide resin or polyimide resin with low heat absorptivity and coefficient of thermal conductivity, heating performance of radiant heat from the halogen heater 25 to the metal layer (for example, heating layer 43) can be made sufficient.

Thus, the sliding layer 47 maintains slidability between the inner surface of the fixing belt 21 and the supporting member 22 over a long period of time. Further, heating efficiency of the heating layer 43 by the radiant heat from the halogen heater 25 (heat absorption efficiency of the heat absorption layer 45) can be maintained. This further enhances effects of shortening the warm-up period and reducing power consumption of the fixing device 13, also lengthening service life for the fixing belt 21.

The size and the shape of the hole 47*a* are not particularly limited. However, heat absorption efficiency of the heat absorption layer 45 increases as a ratio of the hole 47*a* area with respect to a total area of the inner surface of the fixing belt 21 increases. Considering the heat absorption efficiency of the heat absorption layer 45, it is preferred that the ratio of the hole 47*a* area with respect to the total area of the inner surface of the fixing belt 21 be equal to or more than 50%.

Meanwhile, since the mesh part (frame portion) of the sliding layer 47 is thinned as the ratio of the hole 47*a* area increases, strength of the sliding layer 47 is degraded. If the individual holes 47*a* become large, the peripheral edge portion 47*b* of the hole 47*a* is easily trapped to the supporting member 22. Therefore, to ensure both of the strength of the sliding layer 47 and the heat absorption efficiency of the heat absorption layer 45, it is preferred that one side of the hole 47*a* of the sliding layer 47 be 0.3 to 2 mm and the width of the mesh part (frame portion) be 0.1 to 1 mm.

The following methods are available as a method for forming the hole 47*a* at the sliding layer 47. A melted polyimide resin, polyamide resin, polyamide-imide resin, or fluorine-based resin is casted into a mold for molding. Alternatively, the resin is formed in a sheet shape and then is punched to manufacture a mesh-patterned sheet. By laminating the manufactured mesh-patterned sheet on the inner surface of the fixing belt 21, the sliding layer 47 with the holes 47*a* is laminated.

Figure 5:
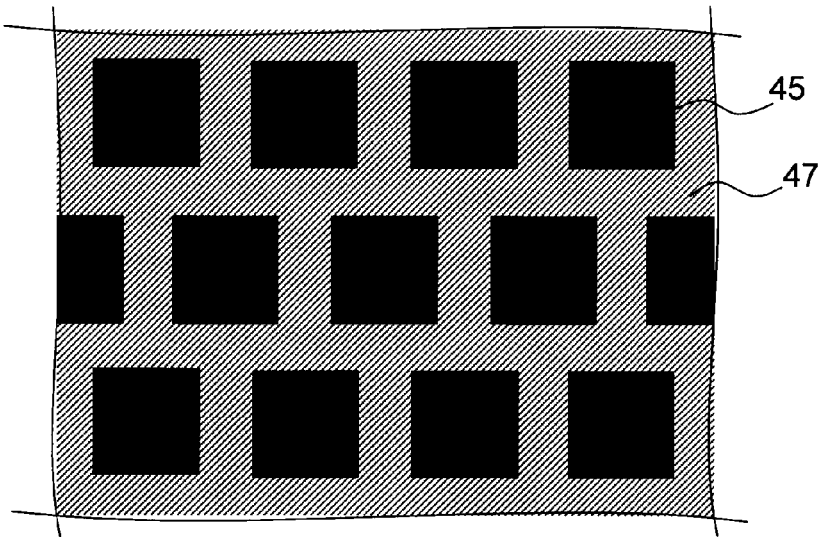
FIG. 5 is a partial plan view illustrating another mesh pattern of the sliding layer 47 of the fixing belt 21.
Figure 6:
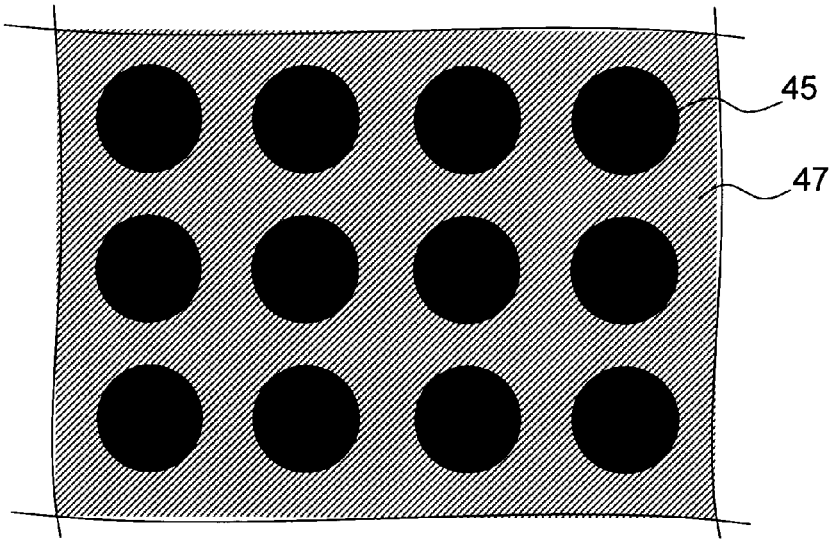
FIG. 6 is a partial plan view illustrating yet another mesh pattern of the sliding layer 47 of the fixing belt 21 with circular holes 47*a*.

FIG. 5 and FIG. 6 are partial plan views illustrating another mesh pattern of the sliding layer 47 of the fixing belt 21. FIG. 5 illustrates a staggered pattern in which rows of the holes 47*a* neighboring in a circumferential direction of the fixing belt 21 (vertical direction in FIG. 5) are shifted widthwise (lateral direction in FIG. 5) by a half pitch in every one row. With the pattern like FIG. 5, viewing the fixing belt 21 in the circumferential direction, the sliding layer 47 is not straightly arranged, and the hole 47*a* from which the heat absorption layer 45 is exposed is always present. As a result, compared with the pattern in FIG. 4, heating distribution of the fixing belt 21 can be further uniformed.

Here, the staggered pattern in which rows of the holes 47*a* neighboring in the circumferential direction of the fixing belt 21 are shifted widthwise by a half pitch is employed. However, a staggered pattern in which rows of the holes 47*a* neighboring in the width direction of the fixing belt 21 are shifted circumferentially by a half pitch may be employed. An amount of shifting of the rows of the holes 47*a* is not limited to a half pitch but can be set as necessary.

FIG. 6 illustrates a circular hole 47*a* pattern of the sliding layer 47. The circular hole 47*a* reduces a trap of the peripheral edge portion 47*b* (see FIG. 3) of the hole 47*a* at the sliding surface between the supporting member 22 and the sliding layer 47. This improves sliding performance of the sliding layer 47, thus ensuring more smooth rotation of the fixing belt 21.

Figure 7:
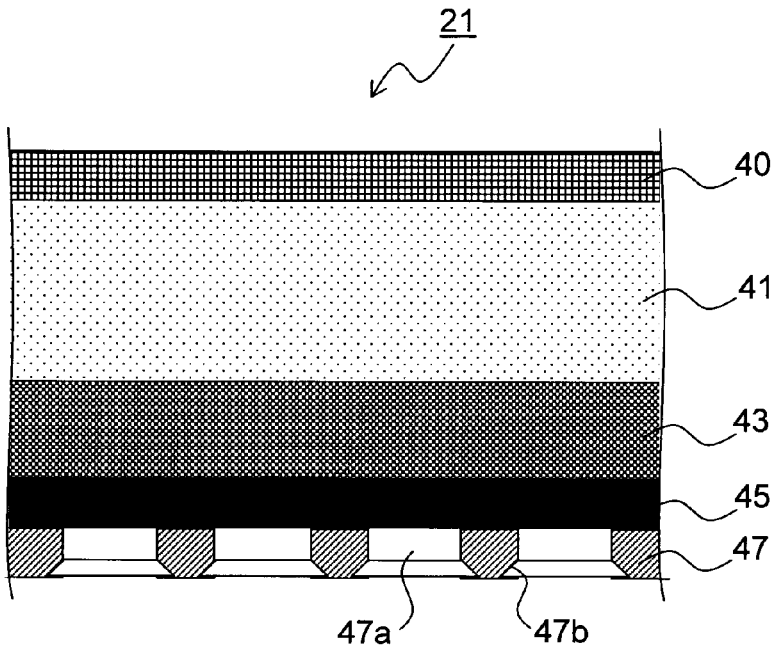
FIG. 7 is a partial cross-sectional view illustrating yet another mesh pattern of the sliding layer 47 of the fixing belt 21 with the circular holes 47*a* and illustrating a chamfered pattern of peripheral edge portions 47*b* of the holes 47*a* formed at the sliding layer 47.

FIG. 7 is a partial cross-sectional view illustrating yet another mesh pattern of the sliding layer 47 of the fixing belt 21. In the pattern illustrated in FIG. 7, the peripheral edge portions 47*b* of the holes 47*a* formed at the sliding layer 47 are chamfered. The chamfered peripheral edge portions 47*b* reduce a trap of the peripheral edge portion 47*b* at the sliding surface between the supporting member 22 and the sliding layer 47 similarly to the pattern in FIG. 6. The peripheral edge portion 47*b* may be a curved surface (R shape) instead of a chamfered shape.

The disclosures are not limited to the respective above-described embodiments, many variations thereof are possible without departing from the spirit of the disclosure. The configurations of the fixing belt 21, the pressure roller 23, and a similar member illustrated in each of the embodiments is one preferable example, for example, and therefore another configuration that can achieve the object of the disclosure is also applicable.

The heat absorption layer 45 is not an essential component, for example. The configuration of directly laminating the mesh-patterned sliding layer 47 on the inner surface of the heating layer 43 may be applicable. Instead of the halogen heater 25, another heating unit, such as an induction heating unit, that heats the heating layer 43 by electromagnetic induction may be disposed. While in the embodiment the hole 47*a* is constituted as a through hole that reaches the heating layer (base material layer) 43, the hole 47*a* may be a depressed portion that reaches close to the heating layer 43.

The fixing device of the disclosure is not limited to the tandem electrophotographic color printer illustrated in FIG. 1. The fixing device of the disclosure is also applicable to various image forming apparatuses employing a sliding-belt fixing method, such as a digital multi-functional peripheral, a color copier, and a monochrome copier of analog method, or a monochrome printer and a facsimile.

The disclosure is applicable to the following fixing device of a sliding-belt fixing method. A supporting member is disposed inside of the fixing belt. The supporting member is brought into pressure contact with a pressure roller from outside of the fixing belt. At the same time, a friction force between the pressure roller and the outer surface of the fixing belt slides the supporting member and the inner surface of the fixing belt, thus the fixing belt is rotated. Use of the disclosure ensures providing the fixing device that features both heating performance of radiant heat from a heating member disposed inside of the fixing belt and sliding performance between the fixing belt and the supporting member.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device, comprising:

an endless fixing belt configured to move at a peripheral speed approximately that of a recording medium's conveyance speed;

a heating unit disposed alongside an inner side of the fixing belt, the heating unit being configured to heat the fixing belt by radiant heat;

a supporting member disposed alongside the inner side of the fixing belt, the supporting member being configured to slide along an inner circumferential surface of the fixing belt; and a pressure roller that together with the supporting member sandwiches the fixing belt to form a fixing nip portion between the pressure roller and the fixing belt, the pressure roller being brought into pressure contact with the supporting member at a predetermined pressure so as to impart rotary driving force to the fixing belt; wherein the fixing device is configured to insert a recording medium into the fixing nip portion to fix an unfixed toner image carried on the recording medium, the fixing belt includes a heating layer and a sliding layer, the heating layer being configured to generate heat using the heating unit, the sliding layer being laminated onto the inner circumferential surface of the fixing belt and sliding on the supporting member, a plurality of holes are formed in the sliding layer such that the sliding layer has a mesh pattern in plan view, and the holes have chamfered peripheral edge portions.

2. The fixing device according to claim 1, wherein:

a heat absorption layer is laminated in the fixing belt between the heating layer and the sliding layer, the heat absorption layer being configured to absorb radiant heat from the heating unit; and the holes are formed to reach the heat absorption layer.

3. The fixing device according to claim 2, wherein the holes are arrayed in a matrix widthwise and circumferentially along the fixing belt, the holes being formed in a staggered pattern in which rows of the holes neighboring widthwise are shifted circumferentially by a predetermined pitch.

4. The fixing device according to claim 2, wherein the holes are arrayed in a matrix widthwise and circumferentially along the fixing belt, the holes being formed in a staggered pattern in which rows of the holes neighboring circumferentially are shifted widthwise by a predetermined pitch.

5. The fixing device according to claim 2, wherein the fixing belt has a ratio of hole area with respect to total area of the inner circumferential surface of the fixing belt equal to or more than 50%.

6. The fixing device according to claim 1, wherein the holes are arrayed in a matrix widthwise and circumferentially along the fixing belt, the holes being formed in a staggered pattern in which rows of the holes neighboring widthwise are shifted circumferentially by a predetermined pitch.

7. The fixing device according to claim 6, wherein the fixing belt has a ratio of hole area with respect to total area of the inner circumferential surface of the fixing belt equal to or more than 50%.

8. The fixing device according to claim 1, wherein the holes are arrayed in a matrix widthwise and circumferentially along the fixing belt, the holes being formed in a staggered pattern in which rows of the holes neighboring circumferentially are shifted widthwise by a predetermined pitch.

9. The fixing device according to claim 8, wherein the fixing belt has a ratio of hole area with respect to total area of the inner circumferential surface of the fixing belt equal to or more than 50%.

10. The fixing device according to claim 1, wherein the fixing belt has a ratio of hole area with respect to total area of the inner circumferential surface of the fixing belt equal to or more than 50%.

11. The fixing device according to claim 1, wherein the holes are formed in a circular geometry in plan view.

12. The fixing device according to claim 1, wherein the chamfered peripheral edge portions of the holes are curved.

13. An image forming apparatus, comprising the fixing device according to claim 1.

* * * * *